United States Patent [19]

Chartrand

[11] Patent Number: 4,889,057

[45] Date of Patent: Dec. 26, 1989

[54] BALCONY RAMP MOUNTED TABLE CONVERTIBLE INTO A SEAT

[76] Inventor: Clément Chartrand, 108 St. Hilaire Street, Longueuil, Canada, J4J 2P2

[21] Appl. No.: 177,538

[22] Filed: Apr. 1, 1988

[51] Int. Cl.[4] ..... A47B 23/00

[52] U.S. Cl. ..... 108/42; 108/38

[58] Field of Search ..... 108/42, 33, 39, 38, 108/47, 48; 297/335, 331, 14; 248/240.1, 207, 558

[56] References Cited

U.S. PATENT DOCUMENTS

| | | | |
|---|---|---|---|
| 203,128 | 7/1936 | Swanson . | |
| 284,343 | 7/1958 | Franks . | |
| 483,669 | 10/1982 | Ganzlin | 108/38 X |
| 1,712,704 | 5/1929 | Riser | 108/38 X |
| 2,469,657 | 5/1949 | Linda et al. | 108/38 |
| 3,710,096 | 1/1973 | McFarlin | 248/207 X |
| 4,159,775 | 7/1979 | Young, Jr. | 108/108 X |
| 4,492,169 | 1/1985 | Ware et al. | 108/108 X |
| 4,548,378 | 10/1985 | Worrallo | 248/558 |
| 4,632,457 | 12/1986 | Hofrichter et al. | 297/335 |

FOREIGN PATENT DOCUMENTS

| | | | |
|---|---|---|---|
| 229718 | 7/1960 | Australia | 108/39 |
| 494979 | 8/1953 | Canada . | |
| 1006082 | 3/1977 | Canada . | |
| 22603 | 1/1912 | Norway | 108/39 |

*Primary Examiner*—Kenneth J. Dorner
*Assistant Examiner*—Jose V. Chen

[57] ABSTRACT

A railing or other vertical structure mounted panel and frame is disclosed. The panel can be unfolded from the frame to define selectively a table or a seat. Panel supports are adjustably attached to the frame to maintain the panel level when the vertical structure is inclined. When folded within the frame, the panel takes up little space and is safe for children.

1 Claim, 3 Drawing Sheets

BALCONY RAMP MOUNTED TABLE CONVERTIBLE INTO A SEAT

FIELD OF THE INVENTION

The present invention relates generally to panels adapted to fold down from a wall to serve as seats or tables.

BACKGROUND OF THE INVENTION

It is known in the art to provide fold-down seats and tables. However, till now, none of the prior constructions have had the versatility of serving as either a table or a seat when unfolded away from a wall or other similar generally vertical structure.

OBJECTS OF THE INVENTION

In view of the above, it is an important object of the present invention to provide a panel which is attachable to a generally vertical structure, such as a balcony railing, and which can be selectively unfolded to form either a table or a seat as desired.

It is another object of the present invention to provide a panel of the above type, which is completely safe for children.

It is yet another object of the present invention to provide a panel of the above type, which is both very simple in design and very easy to set up.

SUMMARY OF THE INVENTION

The above and other objects and advantages of the present invention are realized according to two preferred embodiments, the first comprising a generally rectangular support frame. The frame is provided with attachment means to attach it, detachably so, to a vertical structure, such as a balcony railing or a wall.

A panel of the same width and of slightly shorter length than the frame is pivotally selectively attached to the frame by one of two pivot means, at the lower side portions of the frame when it is desired to use the panel as a seat, and at the upper side portions of the frame when it is desired to use the panel as a table. At both locations, the panel is pivoted at its two back corners to the frame and can be folded within the frame about either pivot means.

Support means are further provided to maintain the panel in unfolded position. Preferably, such support means is adjustable so that the unfolded panel will remain horizontal in unfolded condition, even if the railing or wall structure to which the frame is attached is inclined with respect to the true vertical.

The second embodiment contemplated differs from the first embodiment in that the frame and panel are made of metal and constructed differently.

BRIEF DESCRIPTION OF THE DRAWINGS

The above will be more clearly understood by having referral to the preferred embodiments of the invention, illustrated by way of the accompanying drawings, in which.

Like numerals indicate like elements throughout the drawings.

DETAILED DESCRIPTION OF THE PREFERRED EMBODIMENT

Figure 1:
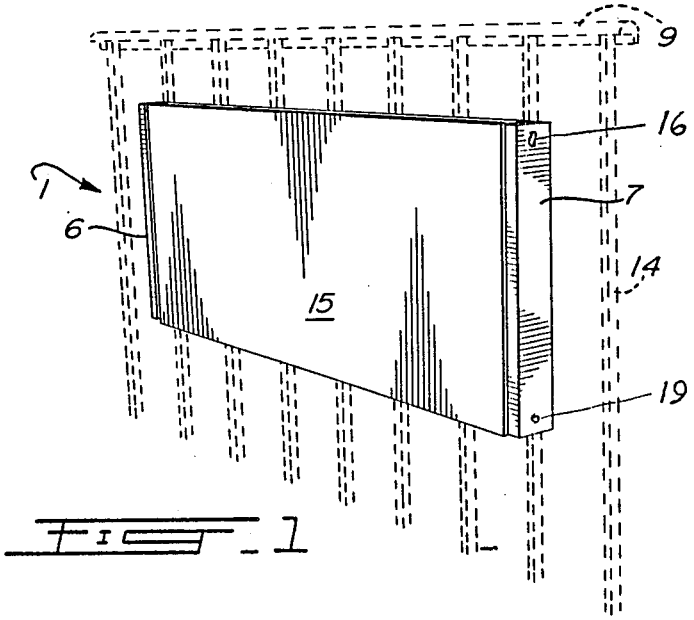
FIG. 1 is a perspective view of the first embodiment of the invention installed on a railing, shown in dashed outline, and in folded condition.

FIGS. 1 to 4 advantageously show the first embodiment of the foldable panel and frame, preferably made of wood and designated generally at 1.

The frame 2 consists of an upper beam 3 and a lower beam 4. Each end of both beams 3, 4 is formed with a tongue, one of which is shown at 5 in FIG. 4. The two beams 3, 4 are joined on each side by posts 6, 7, having their longer dimension oriented parallel to the back to front vertical plane and projecting forwardly of the beams, as clearly seen in FIG. 4. Each post 6, 7 has at each corner grooves, such as indicated at 8, adapted to form a tongue and groove joint along with the tongues at each corner of the frame thus assembled.

Figure 4:
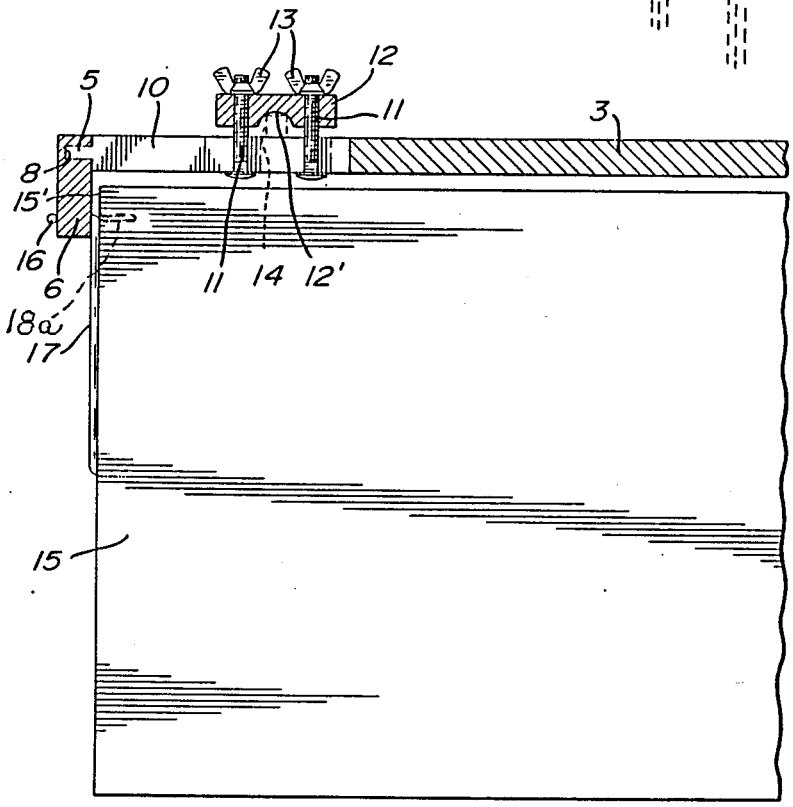
FIG. 4 is a top plan view, partially sectioned, of the left-side portion of FIG. 3.

An attachment means is provided to attach the frame to a vertical structure. The latter is preferably a balcony railing 9 with spaced upright bars 14, as shown in the figures, and the means consists of a pair of spaced-apart slots 10 formed in the end portions of upper beam 3. Fitting through each slot are two fastening bolts 11. A rectangular clamp block 12 has two holes, one for each bolt 11, and the latter are tightened against the block 12 by a pair of wing nuts 13. As seen in FIG. 4, both blocks 12 are formed with a central groove 12' in their forward face, such groove being placed against the rear side of a railing bar 14, thereby rigidly and detachably attaching upper beam 3 to balcony railing 9. Slots 10 enable lateral adjustment of blocks 12 to suit different spacings of railing bars 14.

Figure 2:
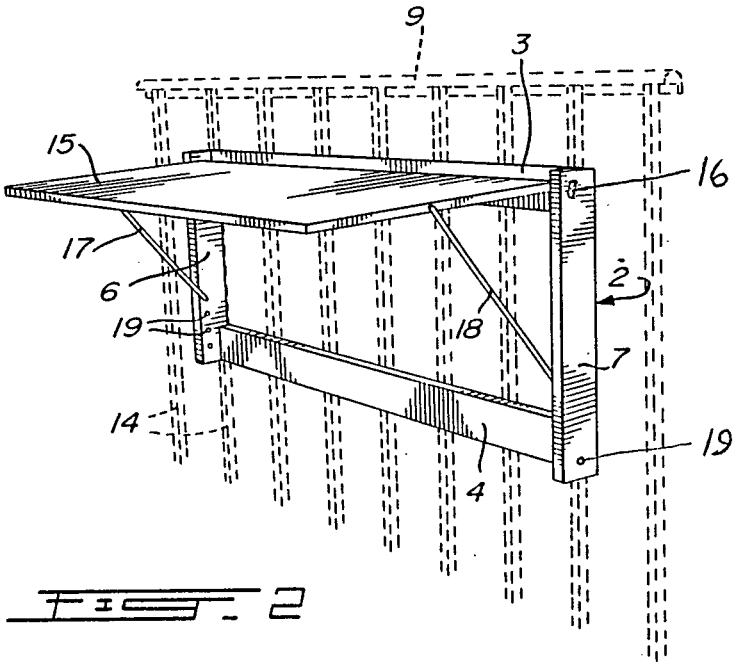
FIG. 2 is another perspective view of the embodiment of FIG. 1, but unfolded for use as a table.
Figure 6:
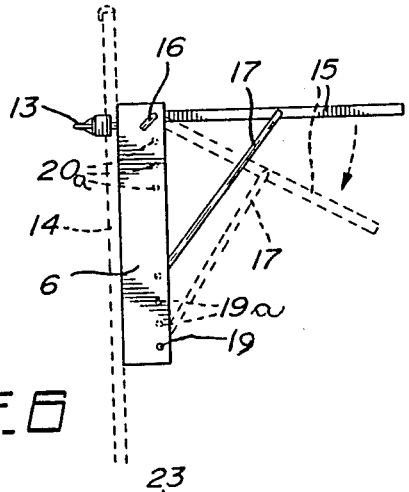
FIG. 6 is another lateral elevation of the first embodiment showing the unfolded panel in table condition, also showing in dashed outline a railing and another adjusted position of the support means, respectively.

Referring now to FIGS. 2 and 6, frame 2 is mounted on balcony railing 9. A panel 15 is disposed in unfolded position to form a table and is pivotally attached to the frame at its two back corners by a first pivot means. The first pivot means comprises an L-shape pivot pin 16 having a bent exterior portion, and a transverse through-bore 20 made therefor in the upper portion of posts 6, 7. Below through-bore 20 there is a series of holes 20A made in and opening inwardly of the upper portion of each post 6, 7. A hole 18A, adapted to register with through-bore 20, is made in the back side edge portion 15' of panel 15 on both sides thereof. Pins 16 are inserted into the respective registering bore 20 and hole. When it is desired to dismantle the assembly of panel 15 and frame 2, the two pivot pins 16 are simply pulled out by their bent portions.

As shown in FIG. 1, panel 15 when folded, fits between the two posts 6 and 7. Closure or lock means (not shown) may be provided to keep panel 15 in closed position.

The support means referred to above consists of a pair of rigid struts 17, 18, each having one end outwardly bent and the opposite end inwardly bent. The latter end of each strut 17, 18 is adapted to be placed in a small bore made at the general mid-point of each lateral edge of panel 15, while the first-named ends of the struts are insertable into one of a plurality of vertically-spaced strut holes 19A formed in the lower portions of posts 6, 7. Holes 19A constitute a simple adjustment for the struts should it be desired to incline the table (FIG. 6) or if a railing is inclined, or its bars curved, to keep the table horizontal. The struts are removed and stored away when panel 15 is in folded condition.

Figure 3:
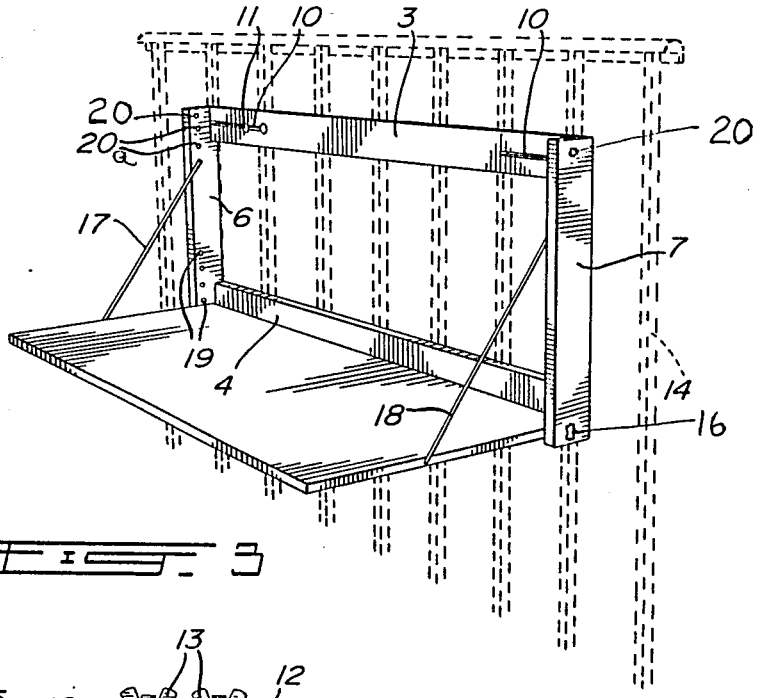
FIG. 3 is another perspective view of the embodiment of FIG. 1, unfolded for use as a seat.
Figure 5:
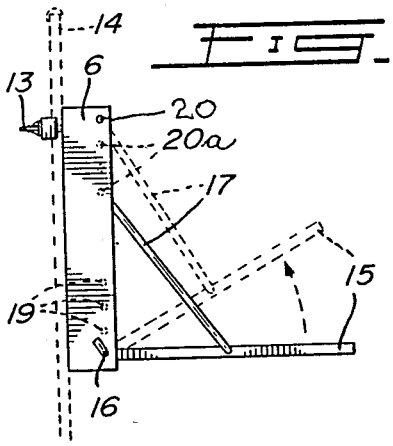
FIG. 5 is a lateral elevation of the embodiment of FIG. 1 showing a panel in unfolded seat condition, showing in dashed outline a railing and an adjusted portion of the support means, respectively.

FIGS. 3 and 5 show the panel 15 converted to a seat. Panel 15 is pivoted at its lateral edge portion to the two lower corners of the frame by insertion of the same pivot pins 16 through the lowermost ones of a series of holes 19 made in the lower portion of each post 6, 7. In seat condition, panel 15 can again be folded within frame 2.

FIG. 5 shows how the panel may be inclined when in seat condition. The adjustment is the same as described above, except that the vertically-spaced holes 20 are used.

Figure 7:
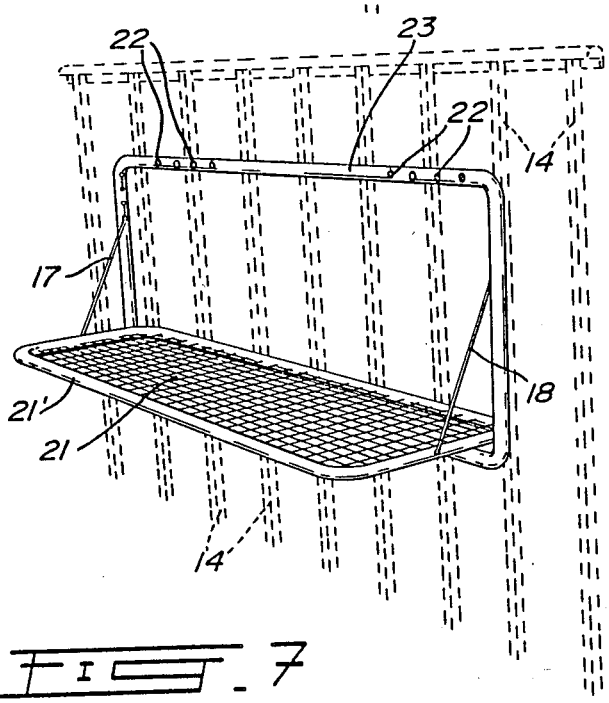
FIG. 7 is a perspective view of a second embodiment according to the invention and in seat condition.

FIG. 7 shows a modified embodiment of the invention. The frame 23 again is rectangular but made of hollow metal tubing, and the solid panel is replaced by a grille 21, having a perimeter of tubing 21'.

The attachment means is slightly modified, consisting of a plurality of transversley-spaced holes 22 to replace the slots 10 on each side of the frame. The clamp 12 may also be modified.

The pivot means and the support means are the same as those of the first embodiment.

It is to be noted that the invention herein described saves space and eliminates the need for two separate articles in a limited area.

It is to be further noted that the invention, in folded condition, is completely safe for children, as in FIG. 1: panel 15 completely covers the lower beam 4, thus preventing a child from gaining a foothold to climb the railing 9.

What I claim is:

1. A table convertible into a seat and attachable to a balcony railing having a plurality of spaced-apart vertical bars, comprising a generally rectangular frame including an upper beam, a lower beam and a pair of parallel posts joining said beams and projecting forwardly of said beams, and each post having an upper and a lower portion, a first transverse through-hole in the upper portion of each of said posts, a second transverse through-hole in the lower portion of each of said posts, attachment means to detachably attach said frame to and flat against said railing bars, said attachment means comprising a pair of spaced-apart slots formed in said upper beam, extending longitudinally thereof and respectively adjacent one of said posts, a clamp block for each slot, each clamp block having a pair of spaced-apart first through-bores and a central groove, two fastening bolts extending through said slot and through said spaced-apart first through-bores and wing nuts for said bolts to tighten said clamp block against one of said bars, said bars positioned in said central groove, a rectangular panel, of a size to nest within a boundary defined by said beams and posts, said panel having opposite back side edge portions, said back side edge portion including pivot means to selectively pivotally connect said opposite back side edge portions to either ones of said first and second transverse through-holes of said posts for pivotal movement of said panel between a folded position nesting within said boundary and overlapping said upper and lower beams, and an unfolded position normal to said frame, said panel thus pivotable at a higher level or at a lower level with respect to said posts, and brace means to releasably and selectively maintain said panel in unfolded position at said higher or at said lower level, whereby said panel, when unfolded, can be used as a table when at said higher level, and as a seat when at said lower level.

* * * * *